United States Patent [19]

Suizu et al.

[11] Patent Number: 4,924,640

[45] Date of Patent: May 15, 1990

[54] VIBRATION CONTROLLING APPARATUS FOR BUILDINGS

[75] Inventors: Yoji Suizu, Koganei; Nobuo Masaki, Tokorozawa; Takafumi Fujita, Nagareyama; Hiroshi Kurabayashi, Tokyo, all of Japan

[73] Assignees: Bridgestone Corporation, Tokyo; Takafumi Fujita, Chiba, both of Japan

[21] Appl. No.: 257,892

[22] Filed: Oct. 14, 1988

[30] Foreign Application Priority Data

Oct. 16, 1987 [JP] Japan ..... 62-261239

[51] Int. Cl.[5] ..... E02D 27/34

[52] U.S. Cl. ..... 52/167 DF; 52/1

[58] Field of Search ..... 52/167

[56] References Cited

U.S. PATENT DOCUMENTS

| | | | |
|---|---|---|---|
| 4,429,496 | 2/1984 | Masri . | |
| 4,593,501 | 6/1986 | Delfosse | 52/167 R |
| 4,635,892 | 1/1987 | Baker | 52/167 DF |
| 4,713,917 | 12/1987 | Buckle | 52/167 R |
| 4,799,339 | 1/1989 | Kobori | 52/167 CB |

FOREIGN PATENT DOCUMENTS

| | | | |
|---|---|---|---|
| 984959 | 7/1951 | France | 52/167 DF |
| 2560265 | 8/1985 | France | 52/167 DF |
| 59-97341 | 6/1984 | Japan . | |
| 164520 | 8/1985 | Japan | 52/167 DF |
| 61-165044 | 7/1986 | Japan . | |
| 838014 | 6/1981 | U.S.S.R. | 52/167 DF |
| 962557 | 9/1982 | U.S.S.R. | 52/167 DF |
| 1193245 | 11/1985 | U.S.S.R. | 52/167 DF |
| 1301948 | 4/1987 | U.S.S.R. | 52/167 DF |

*Primary Examiner*—Henry E. Raduazo

*Attorney, Agent, or Firm*—Sughrue, Mion, Zinn, Macpeak & Seas

[57] ABSTRACT

A vibration controlling apparatus for buildings such as high-rise building, tower and the like comprises a laminated elastic body comprised of elastomer layers and reinforcing plates attached to the building, and an additional mass attached thereto, and reduces the swinging of the building.

7 Claims, 8 Drawing Sheets

VIBRATION CONTROLLING APPARATUS FOR BUILDINGS

BACKGROUND OF THE INVENTION

1. Field of the Invention

This invention relates to a vibration controlling apparatus for buildings which reduces the swinging in the building of a flexible structure system such as high-rise building, tower or the like due to earthquake, wind or the like.

2. Related Art Statement

In the high buildings such as high-rise buildings, various towers and the like, there is adopted a flexible structure system for absorbing vibration energy to increase the earthquake proof strength.

In this flexible structure system, however, the swinging not only is caused at strong wind or earthquake but also becomes large even at normal wind, so that the living comfortability may be reduced.

As a means for reducing the vibration amplitude at normal wind to improve the living comfortability and at the same time reducing the deformation of the building as a whole even at strong wind or earthquake, therefore, it has been proposed to arrange a dynamic vibration reducer (i.e. dynamic damper) for the generation of vibration counteracting the swinging of the building, which comprises a combination of a main spring system consisting of the building itself and an auxiliary spring system connected to the building through a spring and provided with an additional mass and is set so that the natural frequency (vibration period) is approximately equal between the main spring system and the auxiliary spring system to realize the vibration absorbing effect. FIG. 13 shows a structure of this type of the conventional dynamic vibration reducer.

As shown in FIG. 13, a lower part mass 33 movable along a pair of rails 32 horizontally placed on a building 31 (e.g. a top of a tower or the like) in a given direction (Y-direction) and an upper part mass 35 movable along a pair of rails 34 horizontally placed on the lower part mass 33 in a given direction (X-direction) are supported by spring members (not shown) such as spring and the like extending in the Y-direction and X-direction, respectively. Further, each of these masses 33, 35 is slidably supported by a roll having a small friction coefficient, respectively.

Thus, the conventional dynamic vibration reducer for the building is a two-dimensional apparatus, wherein the dynamic vibration reducing effect to the vibration (swinging) of the building 31 in the Y-direction is obtained by the auxiliary spring system consisting of springs of the Y-direction and the upper part mass 35 and lower part mass 33, and the dynamic vibration reducing effect to the vibration (swinging) in the X-direction is obtained by the auxiliary spring system consisting of springs of the X-direction and the upper part mass 35.

In the conventional vibration controlling apparatus for buildings, however, the main spring system and auxiliary spring system having substantially the same vibration period are merely connected to each other (passive damper), so that if it is intended to make the vibration controlling effect large, the mass ratio of the building 31 to additional masses 33, 35 becomes large (in a direction approaching to 1.0) and consequently it is required to increase the strength of the building 31 and the like, which is difficult to be practically realized.

Since the conventional vibration controlling apparatus is a passive damper as mentioned above, the vibration response ratio is determined by the masses 33, 35, spring constant and vibration damping coefficient of the dynamic vibration reducer (auxiliary spring system). As a result, this apparatus has a large effect for particular vibration frequency component, but can not expect the vibration reducing effect against vibrations of wide frequency band such as random vibration and the like.

Further, each of the masses 33, 35 is supported by a roll bearing or the like, so that the static friction coefficient is large in the vibration reducing operation and consequently only the reducing effect against large external force is obtained and the effect to minute vibration can not be obtained.

SUMMARY OF THE INVENTION

It is an object of the invention to solve the aforementioned problems of the conventional techniques and to provide a vibration controlling apparatus for buildings which can largely reduce the vibrations (swinging) of the building over a wide frequency band and can respond immediately to small vibrations because the friction sliding portion is not existent even in the vibration reducing operation.

According to the invention, there is the provision of a vibration controlling apparatus for buildings, characterized in that an additional mass is attached to a building through an elastic support means utilizing a lateral elasticity of a laminated elastic body obtained by alternately laminating an elastomer layer and a reinforcing plate one upon the other and an excitation force of a given waveform corresponding to vibration of said building is applied to said additional mass.

BRIEF DESCRIPTION OF THE DRAWINGS

The invention will be described with reference to the accompany drawings, wherein.

DESCRIPTION OF THE PREFERRED EMBODIMENTS

The invention will be described in detail with reference to FIGS. 1 to 12 below.

Figure 1:
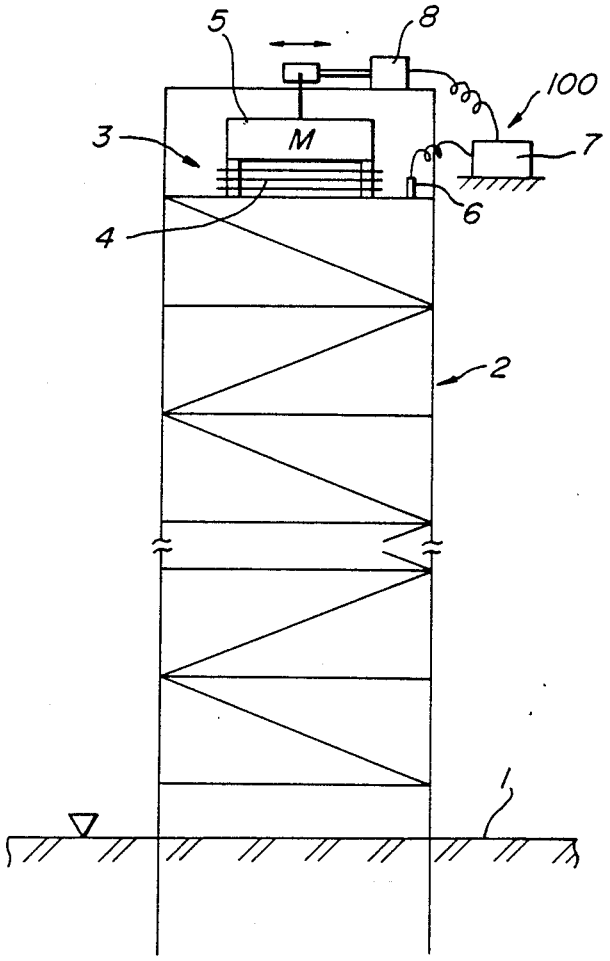
FIG. 1 is a schematically elevational view of a building provided with the vibration controlling apparatus according to the invention.

FIG. 1 schematically shows a building provided with the vibration controlling apparatus according to the invention.

In FIG. 1, the tower-like building 2 is built on a ground 1, and the vibration controlling apparatus 100 according to the invention is placed on a top floor of the building 2.

As a typical example of the building 2, mention may be made of a steel structure building having a section of square, rectangle, lozenge or the like with a side of, for example, 10–25 m and a height of 60–150 m and swinging, for example, at a vibration period of about 2 seconds and an amplitude of few meters through wind pressure, and the like.

In the vibration controlling apparatus 100, an additional mass 5 is attached to the building 2 through a horizontal spring means 4 to construct a dynamic vibration reducer 3, while the vibration (swinging) of the building 2 is detected by a vibration sensor 6 and then a vibration waveform counteracting the vibration of the building 2 is produced by a control unit 7 based on the detected signal and vibration is applied to the additional mass 5 by an actuator 8 actuating based on the vibration waveform to thereby reduce the swinging of the building 2.

The horizontal spring means or elastic support means 4 acts to elastically support the additional mass 5 to the building 2 at a horizontally displaceable state and has a structure utilizing a lateral elasticity of a laminated elastic body (rubber laminate) obtained by alternately laminating an elastomer layer and a reinforcing plate one upon the other as mentioned later.

That is, the vibration controlling apparatus 100 comprises the dynamic vibration reducer 3 consisting of a main vibration system of the building 2 and an auxiliary spring system connecting thereto and composed of the horizontal mass 4 and the additional spring 5 having substantially the same vibration period and can effectively reduce the swinging of the building 2 by producing a vibration waveform counteracting the vibration state of the building 2 and then vibrating the additional mass 5 through the actuator 8 actuating based on the vibration waveform even when the building 2 is subjected to various excitation forces over a wide frequency band.

Figure 2:
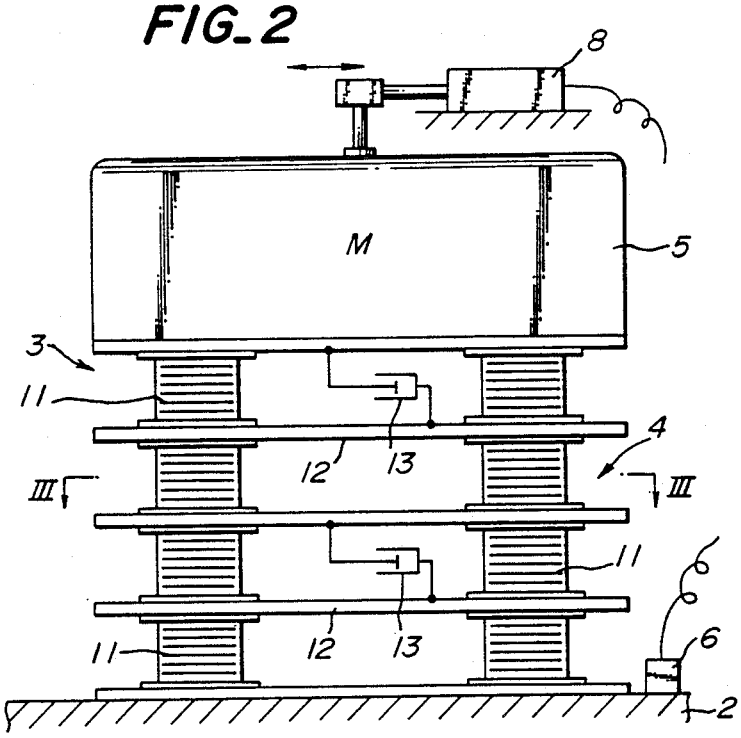
FIG. 2 is a front view of a dynamic vibration reducer shown in FIG. 1.
Figure 3:
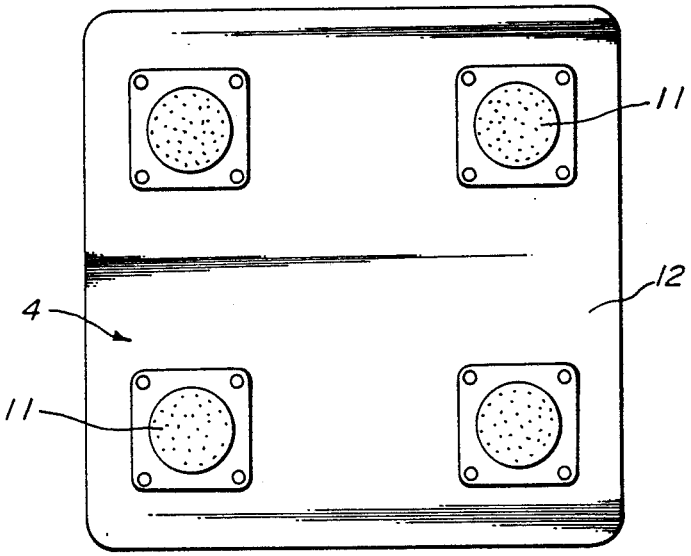
FIG. 3 is a sectional view taken along a line III—III of FIG. 2.

FIG. 2 shows a front view of the auxiliary spring system constituting the dynamic vibration reducer, and FIG. 3 shows a transversely sectional view taken along a line III—III of FIG. 2.

In FIGS. 2 and 3, the dynamic vibration reducer 3 is constructed by the spring means 4 utilizing the lateral elasticity of the laminated elastic body 11 and the additional mass 5 attached onto the spring means.

In the illustrated embodiment, the spring means 4 is comprised of multi-stage elastic units by piling plural laminated elastic bodies (4 bodies) one upon the other (4 stages) through stabilizing plates 12 each connecting the lower end of the body 11 to the upper end of the other body 11.

Each of these stabilizing plates 12 is a rigid plate and serves to increase an elastic and horizontal displacement ability without causing buckling when the plate is subjected to lateral loading by earthquake or wind.

In the illustrated embodiment, a damping device 13 for damping vibrations in the horizontal direction is incorporated between the adjoining stabilizing plates 12, 12 in a given arrangement.

If necessary, the spring means (elastic support means) 4 may be comprised of a single laminated elastic body 11.

Figure 4:
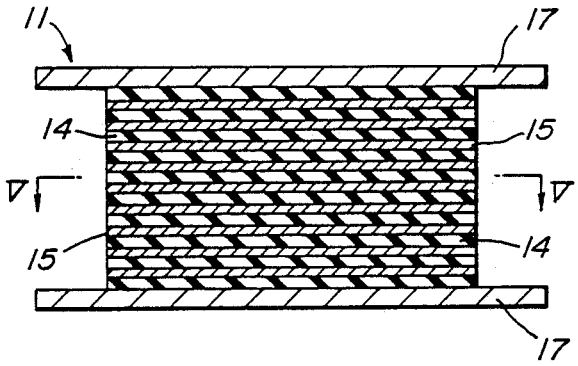
FIG. 4 is a longitudinally sectional view of a laminated elastic body shown in FIG. 2.
Figure 5:
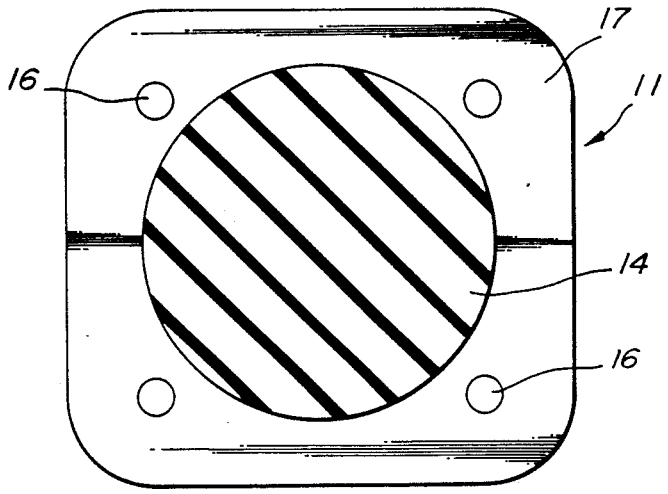
FIG. 5 is a sectional view taken along a line V—V of FIG. 4.

FIG. 4 shows a longitudinally sectional view of the laminated elastic body 11, and FIG. 5 shows a section taken along a line V—V of FIG. 4.

In FIGS. 4 and 5, the laminated elastic body 11 has a structure of alternately laminating a layer 14 of rubber or other elastomer and a reinforcing plate 15 such as metal plate, rigid plastic plate or the like one upon the other, and flange plates 17, 17 each having plural fitting holes 16 are usually bonded to the upper and lower ends of the body 11 by baking, adhesion or the like.

Such a laminated elastic body 11 has a high spring constant in the longitudinal direction and a relatively low spring constant in the horizontal direction.

Figure 6:
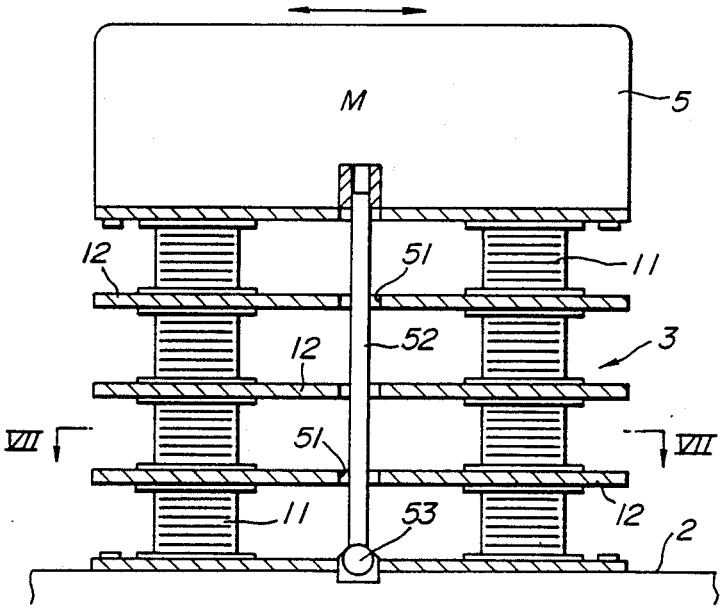
FIG. 6 is a front view of another embodiment of the dynamic vibration reducer according to the invention.
Figure 7:
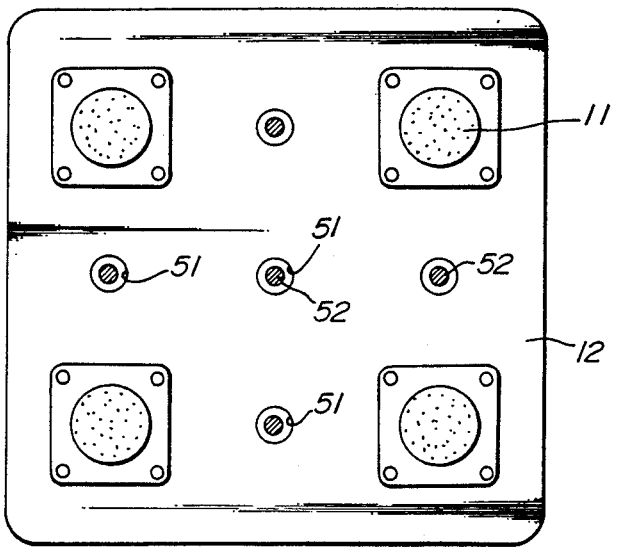
FIG. 7 is a transversely sectional view taken along a line VII—VII of FIG. 6.

FIG. 6 shows a longitudinally sectional view of the dynamic vibration reducer 3 having a mode correcting rod, and FIG. 7 shows a section taken along a line VII—VII of FIG. 6.

In FIGS. 6 and 7, plural through-holes 51 are formed at given positions (5 positions in the illustrated embodiment) in each of the stabilizing plates 12, and a mode correcting rod 52 is inserted into each of these through-holes 51.

The lower end of the mode correcting rod 52 is pivoted to the building 2 through a pivot point 53, while the upper end thereof is engaged to the additional mass 5.

Moreover, the through-hole 51 in the stabilizing plate 12 has such a diameter that the mode correcting rod 52 is freely inserted into the through-hole at a certain gap.

The mode correcting rod 52 is used to correct the distortion of vibration mode in horizontal direction of the multi-stage laminated elastic body unit and prevent the degradation of the vibration damping effect.

Figure 8:
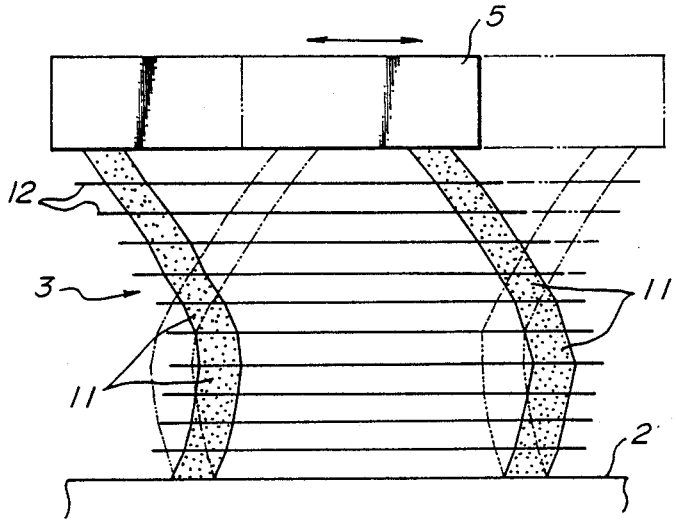
FIG. 8 is a diagrammatical view showing a vibration mode of the dynamic vibration reducer having no mode correcting rod.
Figure 9:
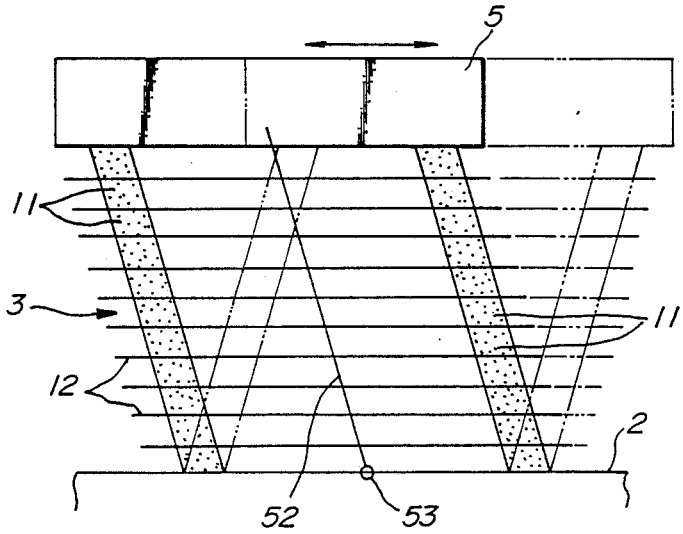
FIG. 9 is a diagrammatical view showing a vibration mode of the dynamic vibration reducer having a mode correcting rod.

FIG. 8 schematically shows a vibration mode of the dynamic vibration reducer 3 having no mode correcting rod 52, while FIG. 9 schematically shows a vibration mode of the dynamic vibration reducer 3 having the mode correcting rod 52.

As seen from FIGS. 8 and 9, the distortion of the vibration mode as shown in FIG. 8 disappears by extending the mode correcting rod 52 from the building 2 through each of the stabilizing plates 12 to the additional mass 5, whereby the dynamic vibration reducer for the building capable of holding the linearity and preventing the degradation of the damping effect is obtained.

Figure 10:
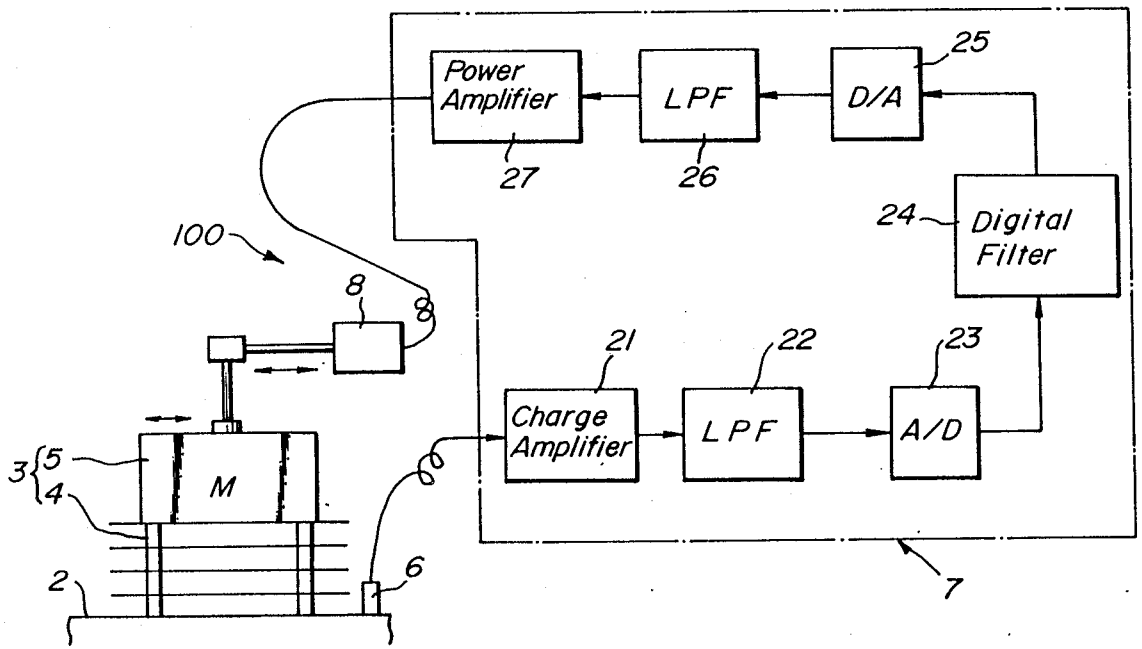
FIG. 10 is a block diagram showing a construction of the vibration controlling apparatus according to the invention.

FIG. 10 shows a block diagram illustrating the construction of the vibration controlling apparatus 100 shown in FIG. 1.

The vibration controlling apparatus 100 according to the invention is constructed to reduce the vibration or swinging of the building 2 by attaching the additional mass 5 to the building 2 through the spring means (elastic support means) 4 explained in FIG. 2, and detecting vibrations generated in the building 2, and applying an excitation force of a given waveform adjusted in accordance with the vibration of the building 2 to the additional mass 5.

In FIG. 10, the control circuit 7 is constructed so that a vibration waveform of a component counteracting the vibration of the building 2 is produced based on a detected signal from vibration sensor 6 detecting the vibration (swinging) of the building 2 to thereby actuate the actuator 8 and then the waveform counteracting the vibration of the building 2 is applied to the additional mass 5.

As shown in FIG. 10, the control circuit 7 is comprised by connecting a charge amplifier 21, a low-pass filter 22, an analog-digital convertor 23, a digital filter 24, a digital-analog convertor 25, a low-pass filter 26 and a power amplifier (signal amplifier) 27 in order, and functions to output a vibration waveform counteracting the vibration of the building 2 from the power amplifier 27 based on the detected signal for the vibration of the building 2 input from the vibration sensor 6 into the charge amplifier 21.

The output from the power amplifier 27 is input to the actuator 8, so that the actuator 8 excites the additional mass 5 at a state of counteracting the vibration of the building 2 and as a result the dynamic vibration reducer 3 acts as an active dynamic damper.

The digital filter 24 has a most important function of forming the waveform signal in the control circuit 7.

If the control signal output from the control circuit 7 exceeds the capacity of the actuator 8, the additional mass 5 is separated from the actuator 8 to shut off the transmission of excitation force, whereby the dynamic vibration reducer 3 consisting of the additional mass 5 and the elastic support means (spring means) 4 can be used as an active dynamic damper.

That is, the illustrated dynamic vibration reducer 3 is comprised of the auxiliary spring system having substantially the same natural frequency as in the building (main spring system) 2, so that it possesses a function that a large vibration in the vicinity of resonant frequency of the building 2 is effectively damped together with the passive damper.

According to the above mentioned embodiment, the vibration state of the building 2 is detected by the vibration sensor 6 arranged on the building 2, and then a signal calculated from the detected signal by the control circuit 7 so as to reduce the vibration of the building is input to the actuator 8 to thereby actuate the active dynamic vibration reducer (dynamic damper), so that the reducer has a structure of small size and light weight. Therefore, the vibration controlling apparatus capable of effectively reducing vibrations over a whole frequency band is obtained even when the building 2 is excited by an external force of a wide frequency band.

Further, the spring of the dynamic vibration reducer 3 is constructed by utilizing the lateral elasticity of the laminated elastic body 11, so that the static friction force can be eliminated, and consequently the vibration controlling apparatus capable of surely responding to small external force is obtained.

And also, the laminated elastic body 11 having uniform spring properties in all of the two-dimensional directions is used, so that the structure of the dynamic vibration reducer 3 can be made simple and inexpensive.

Moreover, when the multi-stage elastomer unit is formed by laminating plural laminated elastic bodies 11 through the stabilizing plates 12 (for example, about 10 stages), even after the unit is assembled on the building 2, the dynamic vibration damping characteristics can easily be adjusted by increasing or decreasing the number of the stages, and consequently the vibration controlling apparatus having an excellent handling property is obtained.

Figure 11:
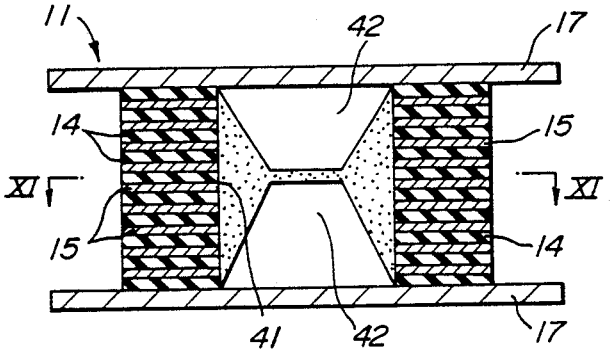
FIG. 11 is a longitudinally sectional view of another embodiment of the laminated elastic body of FIG. 2.
Figure 12:
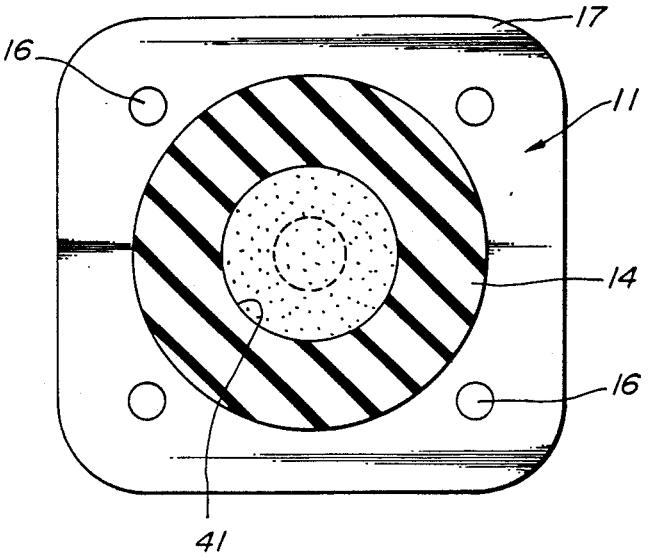
FIG. 12 is a sectional view taken along a line XII—XII of FIG. 11.
Figure 13:
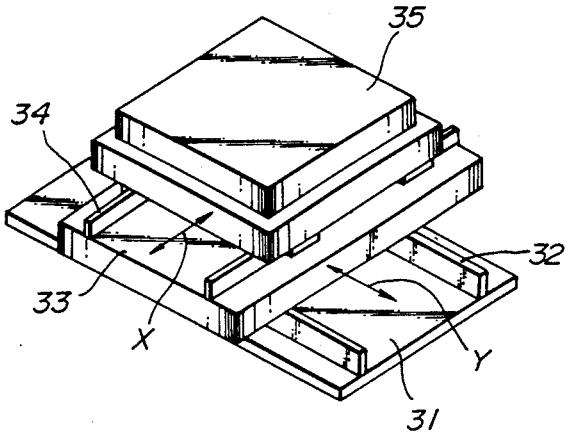
FIG. 13 PRIOR ART
FIG. 13 is a perspective view of the conventional dynamic vibration reducer for the building.

FIG. 11 shows another embodiment of the laminated elastic body 11, and FIG. 12 shows a sectional view taken along a line XII—XII of FIG. 11.

In FIGS. 11 and 12, a hollow portion 41 of a closed state is formed in a central portion of the laminated elastic body 11 obtained by alternately laminating the elastomer layer 14 and the reinforcing plate 15 one upon the other, and a vibration damping means having an increased internal loss is arranged in the hollow portion 41.

In the illustrated embodiment, each of protrusions 42 projecting toward the hollow portion 41 is formed on the inner face of each of the flange plates 17 constituting the both end faces of the laminated elastic body, while a liquid or viscous fluidizing substance (water, oil, green rubber, plastic, asphalt, clay or the like) is filled in the hollow portion 41.

In the laminated elastic body 11 shown in FIGS. 11 and 12, the vibration damping performances may further be improved by utilizing the vibration damping means arranged in the hollow portion as compared with the case of FIGS. 4 and 5.

As mentioned above, in the vibration controlling apparatus for buildings according to the invention, the additional mass is attached through the elastic spring means utilizing the lateral elasticity of the laminated elastic body obtained by alternately laminating the elastomer layer and the reinforcing plate one upon the other, and the excitation force of a given waveform in accordance with the vibration of the building is applied to the additional mass, so that the apparatus is small in the size and light in the weight, and also the vibrations can effectively be reduced over a wide frequency range. Furthermore, the vibration controlling apparatus capable of surely responding to small external force to reduce the swinging is obtained.

What is claimed is:

1. A vibration controlling apparatus for a building, comprising; an additional mass attached to a building, elastic support means for attaching said additional mass to said building, said elastic support means comprising multi-stage elastic units each unit formed by piling plural laminated elastic bodies, each of the elastic bodies having alternately laminated elastomer layers and reinforcing plates, stabilizing plates each connecting one of said elastic units to another of said elastic units and means for applying an excitation force of a given waveform corresponding to vibration of said building to said additional mass, said means for applying an excitation force comprising a vibration sensor for detecting a vibration of said building, means for forming an excitation force of a given waveform based on the detected signal and means for transmitting said excitation force to an actuator.

2. The vibration controlling apparatus according to claim 1 wherein said elastic support means and said additional mass are employed as a passive dynamic vibration reducer when said excitation force is not applied to said actuator.

3. The vibration controlling apparatus according to claim 1 comprising a damper coupled to adjacent stabilizing plates for damping vibration in the horizontal direction.

4. The vibration controlling apparatus according to claim 1 wherein said stabilizing plates have a through-hole, a rod inserted in said through-holes, said rod having one end pivoted to said building and the other end engaging said additional mass.

5. The vibration controlling apparatus according to claim 4 further comprising plural rods passing through said stabilizing plates.

6. The vibration controlling apparatus according to claim 1 wherein said means for forming an excitation force comprises a charge amplifier receiving said detected signal, signal shaping means receiving the output of said charge amplifier and a power amplifier outputting said given waveform.

7. The vibration controlling apparatus according to claim 6 wherein said signal shaping means comprises in sequence first low filter, an analog to digital converter, a digital filter, an digital to analog converter and a second low pass filter, whereby a vibration wave form counteracting the vibration of the building is produced.

* * * * *